US012404863B2

(12) United States Patent
Fukami

(10) Patent No.: US 12,404,863 B2
(45) Date of Patent: Sep. 2, 2025

(54) VACUUM PUMP AND CONTROL DEVICE

(71) Applicant: Edwards Japan Limited, Yachiyo (JP)

(72) Inventor: Hideo Fukami, Yachiyo (JP)

(73) Assignee: Edwards Japan Limited, Yachiyo (JP)

( * ) Notice: Subject to any disclaimer, the term of this patent is extended or adjusted under 35 U.S.C. 154(b) by 0 days.

(21) Appl. No.: 18/710,459

(22) PCT Filed: Dec. 15, 2022

(86) PCT No.: PCT/JP2022/046287

§ 371 (c)(1),
(2) Date: May 15, 2024

(87) PCT Pub. No.: WO2023/112998

PCT Pub. Date: Jun. 22, 2023

(65) Prior Publication Data

US 2025/0020132 A1 Jan. 16, 2025

(30) Foreign Application Priority Data

Dec. 16, 2021 (JP) ..... 2021-204373

(51) Int. Cl.
*F04D 19/04* (2006.01)
*F04D 25/06* (2006.01)
*F04D 27/00* (2006.01)

(52) U.S. Cl.
CPC ..... *F04D 25/06* (2013.01); *F04D 19/042* (2013.01); *F04D 27/001* (2013.01)

(58) Field of Classification Search
CPC ..... F04D 19/042; F04D 27/00; F04D 27/001; F04D 27/008; F04B 37/14
(Continued)

(56) References Cited

U.S. PATENT DOCUMENTS

2005/0212370 A1* 9/2005 Kawashima ..... F16C 32/0446 310/90.5
2014/0203742 A1* 7/2014 Kozaki ..... H02P 6/182 318/400.02
(Continued)

FOREIGN PATENT DOCUMENTS

CN 111441961 A * 7/2020 ..... F04D 29/584
JP 2003232292 A 8/2003
(Continued)

OTHER PUBLICATIONS

International Search Report and Written Opinion of International Application No. PCT/JP2022/046287 dated Feb. 28, 2023, 8 Pages.

*Primary Examiner* — Thomas Fink
(74) *Attorney, Agent, or Firm* — Shumaker & Sieffert, P.A.

(57) ABSTRACT

A vacuum pump including: a current measuring means that measures a current flowing through a motor, in which a first region defined such that a current measured value flowing through the motor is equal to or larger than a current specified value and a rotational speed measured value of a rotor blade is equal to or larger than a rotational speed specified value, a second region defined such that the current measured value flowing through the motor is less than the current specified value or the rotational speed measured value of the rotor blade is less than the rotational speed specified value, a region determining means that determines which region a rotational speed measured value and the current measured value belong, and a calculating means that calculates a risk degree of a failure of the vacuum pump with elapse of time based on the determination by the region determining means.

11 Claims, 9 Drawing Sheets

(58) Field of Classification Search
USPC ..... 417/423.4
See application file for complete search history.

(56) References Cited

U.S. PATENT DOCUMENTS

| | | | | |
|---|---|---|---|---|
| 2017/0306967 | A1* | 10/2017 | Kozaki | F04D 27/001 |
| 2022/0074421 | A1* | 3/2022 | Fukami | F04D 19/048 |
| 2023/0417254 | A1* | 12/2023 | Tanaka | F04D 19/04 |

FOREIGN PATENT DOCUMENTS

| | | | | |
|---|---|---|---|---|
| JP | 2004116328 | A | 4/2004 | |
| JP | 2009287573 | A | 12/2009 | |
| JP | 2011169164 | A | 9/2011 | |
| JP | 2013253502 | A | 12/2013 | |
| WO | WO-2010016176 | A1 * | 2/2010 | H02P 3/18 |
| WO | WO-2021166815 | A1 * | 8/2021 | F04B 49/06 |

* cited by examiner

VACUUM PUMP AND CONTROL DEVICE

This application is a national stage entry under 35 U.S.C. § 371 of International Application No. PCT/JP2022/046287, filed Dec. 15, 2022, which claims the benefit of JP Application No. 2021-204373, filed Dec. 16, 2021, the entire contents of each of which are incorporated herein by reference.

TECHNICAL FIELD

The present disclosure relates to a vacuum pump and a control device and particularly relates to a vacuum pump and a control device having a protective function which can prevent rotor destruction caused by heating without measuring a temperature of a rotor blade.

BACKGROUND

With recent development of the electronics, demand for semiconductors such as memories and integrated circuits are on a rapid increase.

These semiconductors are manufactured by imparting electrical characteristics by doping impurities on a semiconductor substrate with extremely high purity, by forming fine circuits on a semiconductor substrate by etching or the like.

And in order to avoid an influence by dusts and the like in the air, these works may be performed in a chamber in a highly vacuum state. A vacuum pump is generally used for exhaust of this chamber, and a turbo-molecular pump, which is one of the vacuum pumps, is often used in view that maintenance is easy and the like.

Moreover, in a semiconductor manufacturing process, there are many processes in which various types of process gas are made to act on the semiconductor substrate, and the turbo-molecular pump is used not only for vacuuming an inside of the chamber but also for exhausting these process gases from the inside of the chamber.

SUMMARY OF THE INVENTION

A turbo-molecular pump may be used for bringing an environment in a chamber of an electronic microscope or the like into a highly vacuum state in order to prevent refraction of an electronic beam or the like caused by presence of powder dusts and the like in a facility of the electronic microscope and the like.

This turbo-molecular pump includes a magnetic bearing device for magnetically floating/controlling a rotating body. This magnetic bearing device is controlled by a control device, and in this control device, rotation/drive control and position control of the rotating body are executed. And in this control device, in a case of abnormal overheat of the rotating body caused by lowering of a chamber pressure, a protective function is provided for notifying the abnormality and intercepting an operation in order to avoid pump breakage.

By the way, it has become known that, in actual operation in the market, such cases that the pump breakage cannot be avoided with the protective function against pump abnormality which has been conventionally assumed. For example, they are:

(1) a case such that lowering from a target rotational speed and reaching it are repeated with a cycle shorter than specified time; and (2) a case where a vacuum chamber has micro leakage, which does not directly lead to lowering from the target rotational speed, but a maximum torque output state of a drive motor continues for a long time.

Since it can occur due to a very minute cause in either case, a function for notifying an abnormal state before reaching the pump breakage has been in demand also for these cases.

Moreover, in order to prevent such breakage with high accuracy, a sensor for measuring a temperature of the rotor blade can be introduced for highly accurate prevention. However, there is a concern that the introduction of the rotor-blade temperature sensor would make the turbo-molecular pump itself expensive.

The present disclosure was made in view of the conventional problem as above and has an object to provide a vacuum pump and a control device having a protective function which can prevent rotor destruction caused by heating without measuring a temperature of the rotor blade.

Therefore, the present disclosure (claim 1) is a disclosure of a vacuum pump, including a rotor blade that sends a gas sucked through an inlet port to an outlet port, a motor that rotates/drives the rotor blade, a rotational speed measuring means that measures a rotational speed of the rotor blade, and a current measuring means that measures a current flowing through the motor, in which a first region defined such that a current measured value measured by the current measuring means is equal to or larger than a current specified value and a rotational speed measured value measured by the rotational speed measuring means is equal to or larger than a rotational speed specified value, a second region defined such that the current measured value is less than the current specified value or the rotational speed measured value is less than the rotational speed specified value, a region determining means that determines to which region of the first region and the second region the rotational speed measured value and the current measured value belong, and a calculating means that calculates a risk degree of a failure of the vacuum pump with elapse of time on the basis of results of the determination by the region determining means are provided.

The first region is defined such that the current measured value flowing through the motor is equal to or larger than the current specified value and the rotational speed measured value of the rotor blade is equal to or larger than the rotational speed specified value, and the second region is specified such that the current measured value flowing through the motor is less than the current specified value or the rotational speed measured value of the rotor blade is less than the rotational speed specified value. And it is determined to which of the first region and the second region the rotational speed measured values measured by the rotational speed measuring means and the current measured values measured by the current measuring means belong. By calculating the risk degree of a failure of the vacuum pump with elapse of time on the basis of the results of this determination, a breakage failure of the vacuum pump caused by factors of abnormal overheat of the rotor blade and the drive motor can be avoided with an inexpensive method without measuring a temperature of the rotor blade.

Moreover, the present disclosure (claim 2) is a disclosure of a vacuum pump constituted by including a risk-degree threshold value set for the risk degree calculated by the calculating means, an abnormality notifying means that notifies abnormality of the vacuum pump when the risk-degree threshold value is exceeded, and a stopping means that stops an operation of the vacuum pump when the abnormality of the vacuum pump is notified by the abnormality notifying means.

As a result, when the risk degree of a failure of the vacuum pump exceeds the risk-degree threshold value, the abnormality of the vacuum pump can be notified and the operation of the vacuum pump can be stopped on the basis of this abnormality notification and thus, deterioration of the vacuum pump can be efficiently prevented.

Furthermore, the present disclosure (claim 3) is a disclosure of a vacuum pump, characterized in that, when the current measured value measured by the current measuring means and the rotational speed measured value measured by the rotational speed measuring means are both in the first region, if the rotational speed measured value falls from a first rotation number set in advance or more to below the first rotation number, the calculating means determines that the risk degree of a failure of the vacuum pump is excessive.

By determining that the risk degree of a failure of the vacuum pump is excessive, when a detected value of the rotational speed falls from the first rotation number and above set in advance to below the first rotational speed, abnormality of the vacuum pump can be determined instantaneously. The fall of the rotational speed when the motor current value is high and in an overload state means that a friction heat with a gas continues and thus, the abnormality notification and the stop of the vacuum pump are conducted immediately. As a result, a safe operation of the vacuum pump can be realized.

Furthermore, the present disclosure (claim 4) is a disclosure of a vacuum pump, characterized in that the calculating means includes a time measuring means that measures time during which rotation/drive is continued with the rotational speed measured value equal to or smaller the second rotation number set in advance, when the current measured value measured by the current measuring means and the rotational speed measured value measured by the rotational speed measuring means are both in the second region, and when the time measured by the time measuring means becomes equal to or larger than first time set in advance, it is determined that the risk degree of a failure of the vacuum pump is excessive.

Even when a detected value of the current detected by a current detecting means and a detected value of the rotational speed detected by a rotational speed detecting means are both in the second region, by measuring the time during which the rotation/drive is continued with the detected value of the rotational speed at equal to or smaller than the second rotation number set in advance, abnormality of the vacuum pump can be efficiently determined. As a result, the safe operation of the vacuum pump can be realized.

Furthermore, the present disclosure (claim 5) is a disclosure of a vacuum pump, characterized in that the calculating means includes a counter which numerically converts the risk degree of a failure of the vacuum pump and executes processing for the counter of counting up when the rotational speed measured value and the current measured value belong to the first region, while executes processing of counting down when they belong to the second region during a time period (e.g., every second time) on the basis of the determination result of the region determining means.

A difference between time during which the heat remains in the first region and time remaining in the second region is assumed to be heat storage time. And the counter for numerically converting this heat storage time as the risk degree of a failure is provided. This counter is configured such that, when an operation state of the vacuum pump belongs to the first region, the counter is counted up, while when belonging to the second region, the counter is counted down. As a result, there is no need to mount an expensive non-contact blade temperature measuring function exclusively for failure avoidance, and the risk avoidance can be realized inexpensively.

Furthermore, the present disclosure (claim 6) is a disclosure of a vacuum pump, characterized in that when the count value of the counter exceeds a failure reference value determined in advance, it is determined that the risk degree of a failure of the vacuum pump is excessive.

When a count value of the counter indicating the heat storage time reaches specified remaining time, that is, the failure reference value or more, it is determined that there is an overheat risk in the operation. As a result, an excessive increase of the risk degree of a failure of the vacuum pump can be determined inexpensively and efficiently.

Furthermore, the present disclosure (claim 7) is a disclosure of a vacuum pump, characterized in that, the count value of the counter does not become less than zero.

As a result, a memory region occupied by the counter can be made small.

Furthermore, the present disclosure (claim 8) is a disclosure of a vacuum pump, characterized in that the time period or the second time is one second.

The failure reference value is set in order to determine a failure of the vacuum pump, but this failure reference value is a maximum value of the counter, and if measuring time of the counter is one second, this failure reference value can be sensorily determined easily by anyone together with time up to an actual failure in a form in compliance with an actual situation of the vacuum pump operation.

Furthermore, the present disclosure (claim 9) is a disclosure of a vacuum pump, characterized in that, when power source supplied to the motor is disconnected, regenerative braking is performed by rotation of the motor, and the count by the counter is continuously performed during the regenerative braking.

The regenerative braking is started by a power failure. Even in this state, the power source generated by the regenerative braking is supplied to a control power source. Therefore, the determination on the load state and the count by the counter can be continuously performed during the regenerative braking. During this period, since rotation is decelerated, a heat is dissipated. Therefore, a safe operation of the vacuum pump can be realized.

Furthermore, the present disclosure (claim 10) is a disclosure of a vacuum pump, characterized in that, when the power source supplied to the motor is disconnected, and the regenerative braking by the rotation of the motor is finished, the count value of the counter is reset to zero.

The power failure leads to the regenerative braking. The rotation of the motor is decelerated for some time in this state and thus, the heat is dissipated. After that, the power source is completely disconnected, and the value of the counter is reset to zero, but the rotating body touches down the bearing at this time, whereby the heat is directly conducted to the bearing. Thus, when the operation of the vacuum pump is re-started, the heat dissipation has performed substantially completely, and determination on the load state and counting of the counter can be performed again efficiently. Therefore, a safe operation of the vacuum pump is realized.

Furthermore, the present disclosure (claim 11) is a control device that controls a vacuum pump including a rotor blade that sends a gas sucked through an inlet port to an outlet port, a motor that rotates/drives the rotor blade, a rotational speed measuring means that measures a rotational speed of the rotor blade, and a current measuring means that measures a current flowing through the motor, in which a first region defined such that a current measured value measured by the current measuring means is equal to or larger than a current specified value and a rotational speed measured value measured by the rotational speed measuring means is equal to or larger than a rotational speed specified value, a second region defined such that the current measured value is less than the current specified value or the rotational speed measured value is less than the rotational speed specified value, a region determining means that determines to which region of the first region and the second region the rotational speed measured value and the current measured value belong, and a calculating means that calculates a risk degree of a failure of the vacuum pump with elapse of time on the basis of results of the determination by the region determining means are provided.

According to the present disclosure as described above, since it is configured by including the region determining means that determines to which region of the first region and the second region the detected value of the rotational speed detected by the rotational speed detecting means and the current detected value detected by the current detecting means belong and the calculating means that calculates the risk degree of a failure of the vacuum pump with elapse of time on the basis of the results of the determination by the region determining means, the breakage failure of the vacuum pump caused by factors of abnormal overheat of the rotor blade and the drive motor can be avoided with an inexpensive method without measuring a temperature of the rotor blade.

DETAILED DESCRIPTION

Hereinafter, a turbo-molecular pump 100, which is an example of a vacuum pump according to the present disclosure will be described by referring to the figures.

Figure 1:
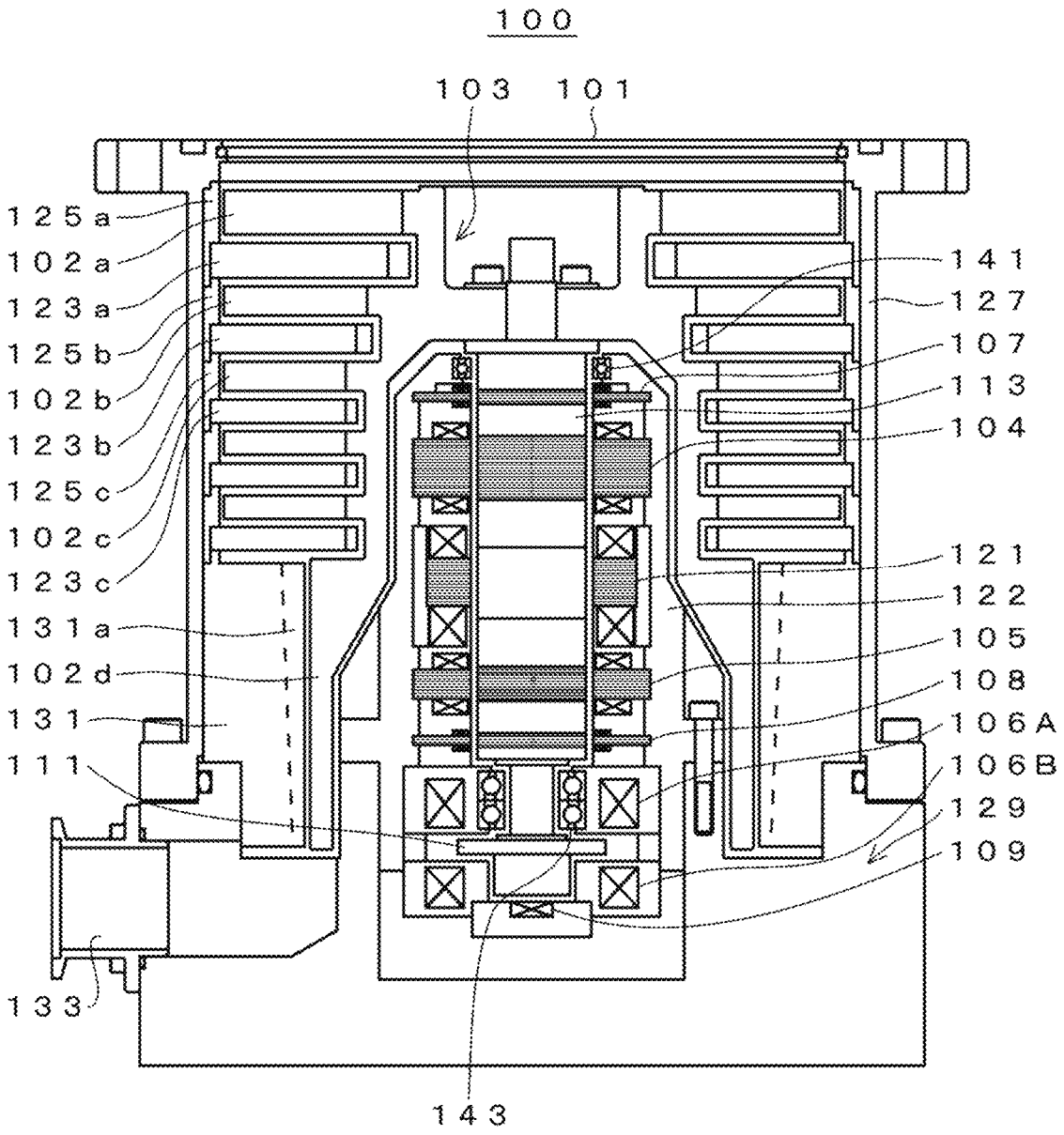
FIG. 1 is a configuration diagram of a turbo-molecular pump used in an example of the present disclosure.

First, configuration of the turbo-molecular pump 100 will be described by referring to FIGS. 1 to 4. FIG. 1 illustrates a configuration diagram of the turbo-molecular pump used in an example of the present disclosure. In FIG. 1, the turbo-molecular pump 100 has an inlet port 101 formed on an upper end of a cylindrical outer cylinder 127. And inside the outer cylinder 127, a rotating body 103 in which a plurality of rotor blades 102 (102*a*, 102*b*, 102*c*, . . . ), which are turbine blades for sucking/exhausting a gas, are formed on a peripheral part radially and in multiple stages is provided. At a center of this rotating body 103, a rotor shaft 113 is mounted, and this rotor shaft 113 is floated/supported in the air and position-controlled by a magnetic bearing of five-axes control, for example. The rotating body 103 is constituted by metal such as aluminum or an aluminum alloy in general.

In an upper-side radial electromagnet 104, four electromagnets are disposed by forming a pair on an X-axis and a Y-axis. In a vicinity of this upper-side radial electromagnet 104, four upper-side radial sensors 107 are provided correspondingly to each of the upper-side radial electromagnets 104. As the upper-side radial sensor 107, an inductance sensor or an ebb-current sensor having conductive wiring is used, for example, and a position of the rotor shaft 113 is detected on the basis of a change in inductance of the conductive wiring changing in accordance with the position of the rotor shaft 113. This upper-side radial sensor 107 is configured so as to detect radial displacement of the rotor shaft 113, that is, the rotating body 103 fixed thereto and to send it to a central processing unit (CPU) of a control device, not shown.

In this central processing unit, functions of a magnetic bearing controller is mounted, and a compensation circuit having a PID adjustment function, for example, generates an excitation control instruction signal of the upper-side radial electromagnet 104 on the basis of a position signal detected by the upper-side radial sensor 107, and an inverter for magnetic bearing, not shown, excites/controls the upper-side radial electromagnet 104 on the basis of this excitation control instruction signal so that a radial position on an upper side of the rotor shaft 113 is adjusted.

And this rotor shaft 113 is formed of a material with high magnetic permeability (iron, stainless or the like) or the like and is configured to be attracted by a magnetic force of the upper-side radial electromagnet 104. Such adjustment is made independently in an X-axis direction and in a Y-axis direction. Moreover, a lower-side radial electromagnet 105 and a lower-side radial sensor 108 are disposed similarly to the upper-side radial electromagnet 104 and the upper-side radial sensor 107, and a radial position on a lower side of the rotor shaft 113 is adjusted similarly to the radial position on the upper side.

Furthermore, axial electromagnets 106A and 106B are disposed by vertically sandwiching a disc-shaped metal disc 111 provided on a lower part of the rotor shaft 113. The metal disc 111 is constituted of a material with high magnetic permeability such as iron. An axial sensor 109 is provided in order to detect an axial displacement of the rotor shaft 113, and it is configured such that an axial position signal thereof is sent to the central processing unit (CPU) of the control device, not shown.

And in the magnetic bearing controller mounted on the central processing unit, the compensation circuit having the PID adjustment function, for example, generates the excitation control instruction signal for each of the axial electromagnet 106A and the axial electromagnet 106B on the basis of an axial position signal detected by the axial sensor 109, and the inverter for magnetic bearing, not shown, excites/controls the axial electromagnet 106A and the axial electromagnet 106B on the basis of the excitation control instruction signals, respectively, so that the axial electromagnet 106A attracts the metal disc 111 upward by the magnetic force, while the axial electromagnet 106B attracts the metal disc 111 downward, and the axial position of the rotor shaft 113 is adjusted.

As described above, the control device appropriately adjusts the magnetic force by the axial electromagnets 106A and 106B applied to the metal disc 111, magnetically floats the rotor shaft 113 in the axial direction and holds it in a space in a non-contact manner. Note that the amplification circuit 150 which excites/controls the upper-side radial electromagnet 104, the lower-side radial electromagnet 105, and the axial electromagnets 106A and 106B will be described later.

On the other hand, a motor 121 includes a plurality of magnetic poles disposed in a circumferential state so as to surround the rotor shaft 113. Each of the magnetic poles is controlled by the control device so that it rotates/drives the rotor shaft 113 through an electromagnetic force acting between it and the rotor shaft 113. Moreover, the motor 121 incorporates rotation speed sensors such as a Hall element, a resolver, an encoder and the like, not shown, for example, and it is configured such that a rotation speed of the rotor shaft 113 is detected by a detection signal of this rotation speed sensor. This rotational speed sensor corresponds to the rotational speed measuring means 21.

Furthermore, in the vicinity of the lower-side radial sensor 108, for example, a phase sensor, not shown, is mounted so as to detect a phase of rotation of the rotor shaft 113. The control device is configured to detect a position of the magnetic pole by using detection signals of both this phase sensor and the rotation speed sensor. With a slight clearance from the rotor blades 102 (102*a*, 102*b*, 102*c*, . . . ), a plurality of stator blades 123 (123*a*, 123*b*, 123*c*, . . . ) are disposed. The rotor blade 102 (102*a*, 102*b*, 102*c*, . . . ) is formed with inclination by a predetermined angle from a plane perpendicular to an axis of the rotor shaft 113 so as to transfer molecules of an exhaust gas thereof by a collision to a lower direction, respectively. The stator blade 123 (123*a*, 123*b*, 123*c* . . . ) is constituted by metal such as aluminum, iron, stainless, copper and the like or metal such as an alloy containing these metals as components, for example.

Moreover, the stator blades 123 are also formed similarly with inclination by a predetermined angle from the plane perpendicular to the axis of the rotor shaft 113 and are disposed alternately with stages of the rotor blades 102 toward an inside of the outer cylinder 127. And outer peripheral ends of the stator blades 123 are supported in a state fitted and inserted between stator-blade spacers 125 (125*a*, 125*b*, 125*c*, . . . ) stacked in plural stages. The stator-blade spacer 125 is a ring-shaped member and is constituted by metal such as aluminum, iron, stainless, copper or the like or an alloy containing these metals as components. On an outer periphery of the stator-blade spacer 125, the outer cylinder 127 is fixed with a slight clearance. On a bottom part of the outer cylinder 127, a base portion 129 is disposed. On the base portion 129, an outlet port 133 is formed and communicates with an outside. An exhaust gas entering from a chamber (vacuum chamber) side into the inlet port 101 and transferred to the base portion 129 is sent to the outlet port 133.

Moreover, depending on an application of the turbo-molecular pump 100, a threaded spacer 131 is disposed between a lower part of the stator-blade spacer 125 and the base portion 129. The threaded spacer 131 is a cylindrical member constituted by metal such as aluminum, copper, stainless, iron or an alloy containing these metals as components, and a plurality of spiral thread grooves 131*a* are engraved in an inner peripheral surface thereof. A spiral direction of the thread groove 131*a* is a direction in which, when the molecule of the exhaust gas is moved in a rotating direction of the rotating body 103, this molecule is transferred toward the outlet port 133. On a lowest part continuing to the rotor blade 102 (102*a*, 102*b*, 102*c* . . . ) of the rotating body 103, a cylinder portion 102*d* is suspended. An outer peripheral surface of this cylinder portion 102*d* has a cylindrical shape and is extended toward the inner peripheral surface of the threaded spacer 131 and is close to the inner peripheral surface of this threaded spacer 131 with a predetermined clearance therebetween. The exhaust gas having been transferred by the rotor blade 102 and the stator blade 123 to the thread groove 131*a* is sent to the base portion 129 while being guided by the thread groove 131*a*.

The base portion 129 is a disc-shaped member constituting a bottom portion of the turbo-molecular pump 100 and is constituted by metal such as iron, aluminum, stainless or the like in general. The base portion 129 physically holds the turbo-molecular pump 100 and has a function of a conducting path of a heat at the same time and thus, metal with rigidity and high heat conductivity such as iron, aluminum, copper or the like is preferably used.

Moreover, on an upper end portion of the stator column 122 between the upper-side radial sensor 107 and the rotating body 103, a touchdown bearing 141 is disposed. On the other hand, below the lower-side radial sensor 108, a touchdown bearing 143 is disposed.

The touchdown bearing 141 and the touchdown bearing 143 are both constituted by ball bearings. The touchdown bearing 141 and the touchdown bearing 143 are provided so that the rotating body 103 can safely shift to a non-floating state, when the rotating body 103 cannot be magnetically floated due to some factor such as abnormal rotation of the rotating body 103, electrical outage or the like.

In the configuration as above, when the rotor blade 102 is rotated/driven together with the rotor shaft 113 by the motor 121, by means of actions of the rotor blade 102 and the stator blade 123, an exhaust gas is sucked from a chamber, not shown, through the inlet port 101. A rotational speed of the rotor blade 102 is usually 20000 rpm to 90000 rpm, and a peripheral speed at a distal end of the rotor blade 102 reaches 200 m/s to 400 m/s. The exhaust gas sucked through the inlet port 101 passes between the rotor blade 102 and the stator blade 123 and is transferred to the base portion 129. At this time, a temperature of the rotor blade 102 is raised by a friction heat generated when the exhaust gas contacts the rotor blade 102 or conduction or the like of a heat generated in the motor 121, and this heat is conducted to the stator blade 123 side by radiation or conduction by a gas molecule or the like of the exhaust gas.

The stator-blade spacers 125 are joined to each other on outer peripheral portions and conduct a heat that the stator blade 123 received from the rotor blade 102, the friction heat generated when the exhaust gas contacts the stator blade 123 and the like to the outside.

Note that, it was explained that the threaded spacer 131 is disposed on the outer periphery of the cylinder portion 102*d* of the rotating body 103, and the thread groove 131*a* is engraved in the inner peripheral surface of the threaded spacer 131 as above. However, to the contrary, the thread groove is engraved in an outer peripheral surface of the cylinder portion 102*d*, and a spacer having a cylindrical inner peripheral surface on a periphery thereof is disposed in some cases.

Moreover, depending on the application of the turbo-molecular pump 100, a periphery of an electric component portion is covered with a stator column 122 so that the gas sucked through the inlet port 101 does not intrude into the electric component portion constituted by the upper-side radial electromagnet 104, the upper-side radial sensor 107, the motor 121, the lower-side radial electromagnet 105, the lower-side radial sensor 108, the axial electromagnets 106A and 106B, the axial sensor 109 and the like, and an inside of the stator column 122 is held at a predetermined pressure by a purge gas in some cases.

In this case, piping, not shown, is disposed in the base portion 129, and the purge gas is introduced through this piping. The introduced purge gas is sent out to the outlet port 133 through clearances between a protective bearing 141 and the rotor shaft 113, between a rotor and a stator of the motor 121, and between the stator column 122 and the inner-peripheral side cylinder portion of the rotor blade 102.

Here, the turbo-molecular pump 100 executes controls based on specification of a model and individually adjusted specific parameters (characteristics corresponding to the model, for example). In order to store the control parameters, the turbo-molecular pump 100 includes an electronic circuit portion in a main body thereof. The electronic circuit portion is constituted by electronic components such as a semiconductor memory such as an EEP-ROM and the like and a semiconductor device and the like for access and substrate for mounting them and the like. This electronic circuit portion is accommodated in a lower part of a rotation speed sensor, not shown, closer to a center, for example, of the base portion 129 constituting the lower part of the turbo-molecular pump 100 and is closed by an air-tight bottom lid.

In a manufacturing process of a semiconductor, some process gases introduced into a chamber have a characteristic that it becomes solid when a pressure thereof becomes higher than a predetermined value or when a temperature thereof becomes lower than a predetermined value. Inside the turbo-molecular pump 100, the pressure of the exhaust gas is the lowest at the inlet port 101 and the highest at the outlet port 133. If the pressure of the process gas becomes higher than the predetermined value or the temperature thereof becomes lower than the predetermined value in the middle of transfer from the inlet port 101 to the outlet port 133, the process gas becomes a solid state and adheres to and is deposited on the inside of the turbo-molecular pump 100.

For example, if $SiCl_4$ is used as a process gas in an Al etching device, it is known from a steam-pressure curve that a solid product ($AlCl_3$, for example) is precipitated at a low vacuum (760 [torr] to $10^{-2}$ [torr]) and at a low temperature (approximately 20 [° C.]) and adheres/deposits inside the turbo-molecular pump 100. As a result, if the precipitates of the process gas are deposited inside the turbo-molecular pump 100, the deposits narrow a pump channel and causes deterioration of performances of the turbo-molecular pump 100. And the aforementioned products were easily solidified and adhered at a part close to the outlet port 133 or to the threaded spacer 131 where the pressure was high.

Thus, in order to solve this problem, conventionally, a heater, not shown, or an annular water-cooling pipe is wound around an outer periphery of the base portion 129 or the like and a temperature sensor (a thermistor, for example), not shown, is embedded in the base portion 129, for example, and heating of the heater or cooling by the water-cooling pipe is controlled (hereinafter, referred to as TMS. TMS:

Temperature Management System) so that the temperature of the base portion 129 is kept at a high temperature (set temperature) on the basis of a signal of this temperature sensor.

Subsequently, regarding the turbo-molecular pump 100 constituted as above, the amplification circuit 150 which excites/controls the upper-side radial electromagnet 104, the lower-side radial electromagnet 105, and the axial electromagnets 106A and 106B will be described. A circuit diagram of this amplification circuit 150 is shown in FIG. 2.

Figure 2:
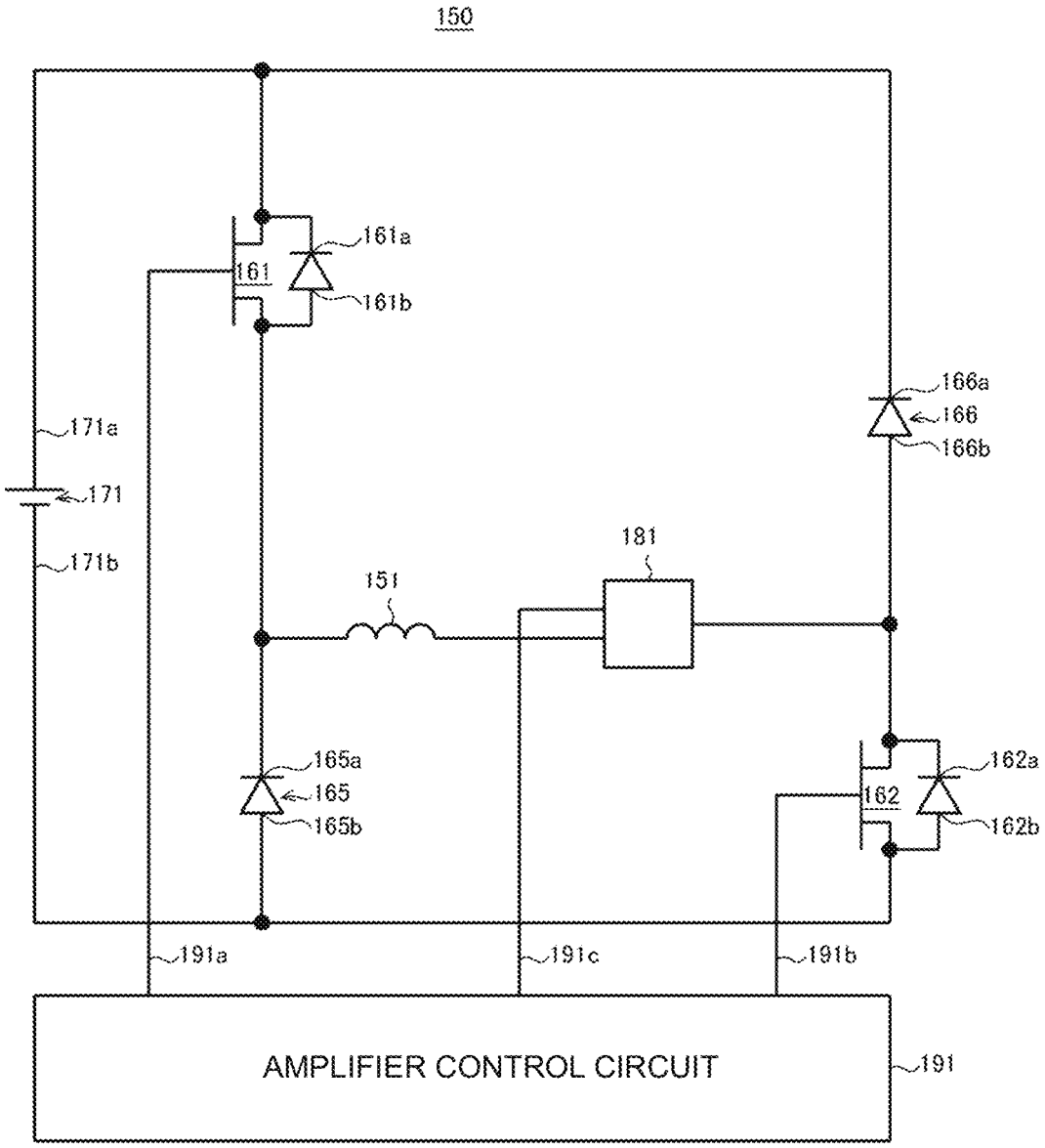
FIG. 2 is a circuit diagram of an amplification circuit of the turbo-molecular pump illustrated in FIG. 1.

In FIG. 2, an electromagnet wiring 151 constituting the upper-side radial electromagnet 104 and the like has one end thereof connected to a positive electrode 171*a* of a power source 171 through a transistor 161 and has the other end connected to a negative electrode 171*b* of the power source 171 through a current detection circuit 181 and a transistor 162. The current detection circuit 181 corresponds to the current detecting means. And the transistors 161 and 162 are so-called power MOSFET and have a structure in which a diode is connected between a source and a drain thereof.

At this time, the transistor 161 has a cathode terminal 161*a* of the diode thereof connected to the positive electrode 171*a* and has an anode terminal 161*b* connected to one end of the electromagnet wiring 151. Moreover, the transistor 162 has a cathode terminal 162*a* of the diode thereof connected to the current detection circuit 181 and has an anode terminal 162*b* connected to the negative electrode 171*b*.

On the other hand, a diode 165 for current regeneration has a cathode terminal 165*a* thereof connected to one end of the electromagnet wiring 151 and has an anode terminal 165*b* thereof connected to the negative electrode 171*b*. Moreover, similarly to this, a diode 166 for current regeneration has a cathode terminal 166*a* thereof connected to the positive electrode 171*a* and an anode terminal 166*b* thereof connected to the other end of the electromagnet wiring 151 through the current detection circuit 181. And the current detection circuit 181 is constituted by a Hall-sensor type current sensor or an electric resistance element, for example.

The amplification circuit 150 constituted as above corresponds to one electromagnet. Thus, in a case where the magnetic bearing is five-axes control and has 10 pieces of the electromagnets 104, 105, 106A and 106B in total, the similar amplification circuit 150 is constituted for each of the electromagnets, and 10 units of the amplification circuits 150 are connected in parallel to the power source 171.

Moreover, an amplification control circuit 191 is constituted by a digital signal processor portion (hereinafter, referred to as a DSP portion), not shown, of the control device 200, for example, and this amplification control circuit 191 is configured to switch on/off the transistors 161 and 162.

The amplification control circuit 191 is configured to compare a current value (a signal reflecting this current value is referred to as a current detection signal 191*c*) detected by the current detection circuit 181 and a predetermined current instructed value. And on the basis of this comparison result, a size of a pulse width (pulse-width time Tp1, Tp2) to be generated in a control cycle Ts, which is one cycle by PWM control, is determined. As a result, gate drive signals 191*a* and 191*b* having this pulse width is configured to be output to gate terminals of the transistors 161 and 162 from the amplification control circuit 191.

Position control of the rotating body 103 may be executed at a high speed and with a strong force when passing a resonant point during an acceleration operation of a rotation speed of the rotating body 103, at occurrence of a disturbance during a constant-speed operation and the like. Thus, a high voltage such as approximately 50V, for example, is used in the power source 171 so that the current flowing through the electromagnet wiring 151 can be rapidly increased (or decreased). Moreover, a capacitor is usually connected between the positive electrode 171*a* and the negative electrode 171*b* of the power source 171 for stabilization of the power source 171 (not shown).

In the configuration as above, when both the transistors 161 and 162 are turned on, the current flowing through the electromagnet wiring 151 (hereinafter referred to as an electromagnet current iL) increases, while when the both are turned off, the electromagnet current iL decreases.

Moreover, when one of the transistors 161 and 162 is turned on, while the other is turned off, a so-called flywheel current is held. And by causing the flywheel current to flow through the amplification circuit 150 as above, a hysteresis loss in the amplification circuit 150 is decreased, and power consumption of the circuit can be kept low. Moreover, by controlling the transistors 161 and 162 as above, a high-frequency noise such as a harmonic generated in the turbo-molecular pump 100 can be reduced. Furthermore, by measuring this flywheel current by the current detection circuit 181, the electromagnet current iL flowing through the electromagnet wiring 151 can be detected.

Figure 3:
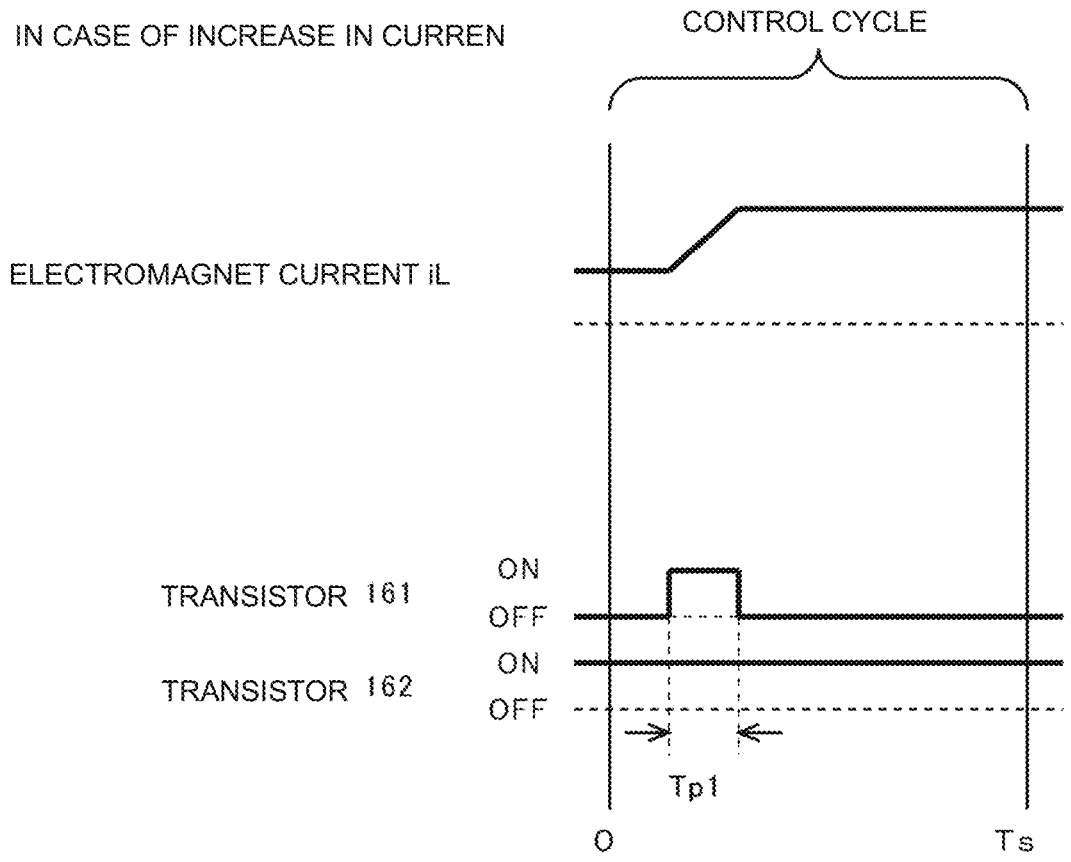
FIG. 3 is a time chart illustrating control when a current instructed value is larger than a detected value.

That is, if the detected current value is smaller than the current instructed value, the transistors 161 and 162 are both turned on for a period of time corresponding to the pulse-width time Tp1 once in a control cycle Ts (100 μs, for example) as shown in FIG. 3. Thus, the electromagnet current iL during this period increases toward a current value iLmax (not shown) that can be made to flow from the positive electrode 171*a* to the negative electrode 171*b* through the transistors 161 and 162.

Figure 4:
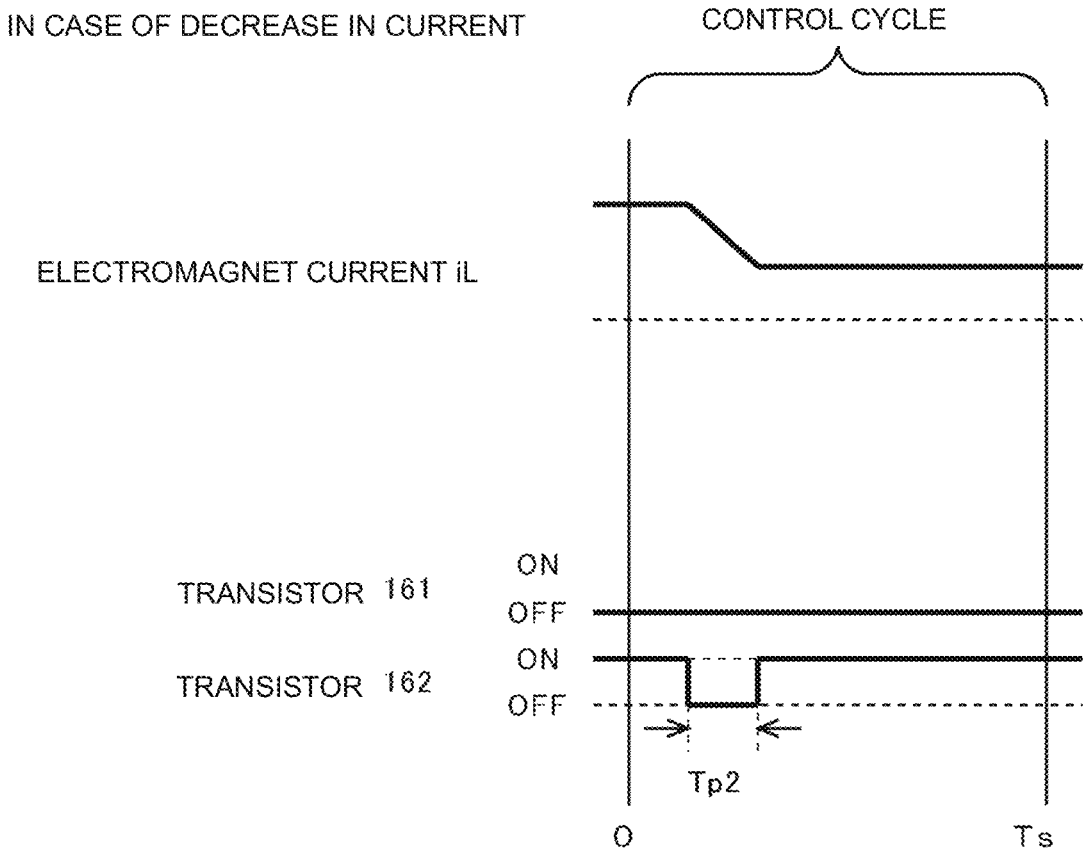
FIG. 4 is a time chart illustrating control when the current instructed value is smaller than the detected value.

On the other hand, if the detected current value is larger than the current instructed value, the transistors 161 and 162 are both turned off for a period of time corresponding to the pulse-width time Tp2 once in the control cycle Ts as shown in FIG. 4. Thus, the electromagnet current iL during this period decreases toward a current value iLmin (not shown) that can be regenerated from the negative electrode 171*b* to the positive electrode 171*a* through the diodes 165 and 166.

And in any case, after elapse of the pulse width time Tp1, Tp2, either one of the transistors 161 and 162 is turned on. Thus, the flywheel current is held in the amplification circuit 150 during this period.

Subsequently, this example will be described in detail by referring to FIGS. 5 to 9.

Here, the rotational speed of the rotor blade 102 is high, and a friction heat is generated between it and the process gas as described above. Since the inside of the turbo-molecular pump 100 is in a vacuum environment, this heat can be easily stored in the rotor blade 102 and the like, and if the heat is stored too much, this could lead to pump breakage.

Thus, an efficient protective function is in demand even against a case with a high possibility of pump breakage as described above that cannot be predicted.

Figure 5:
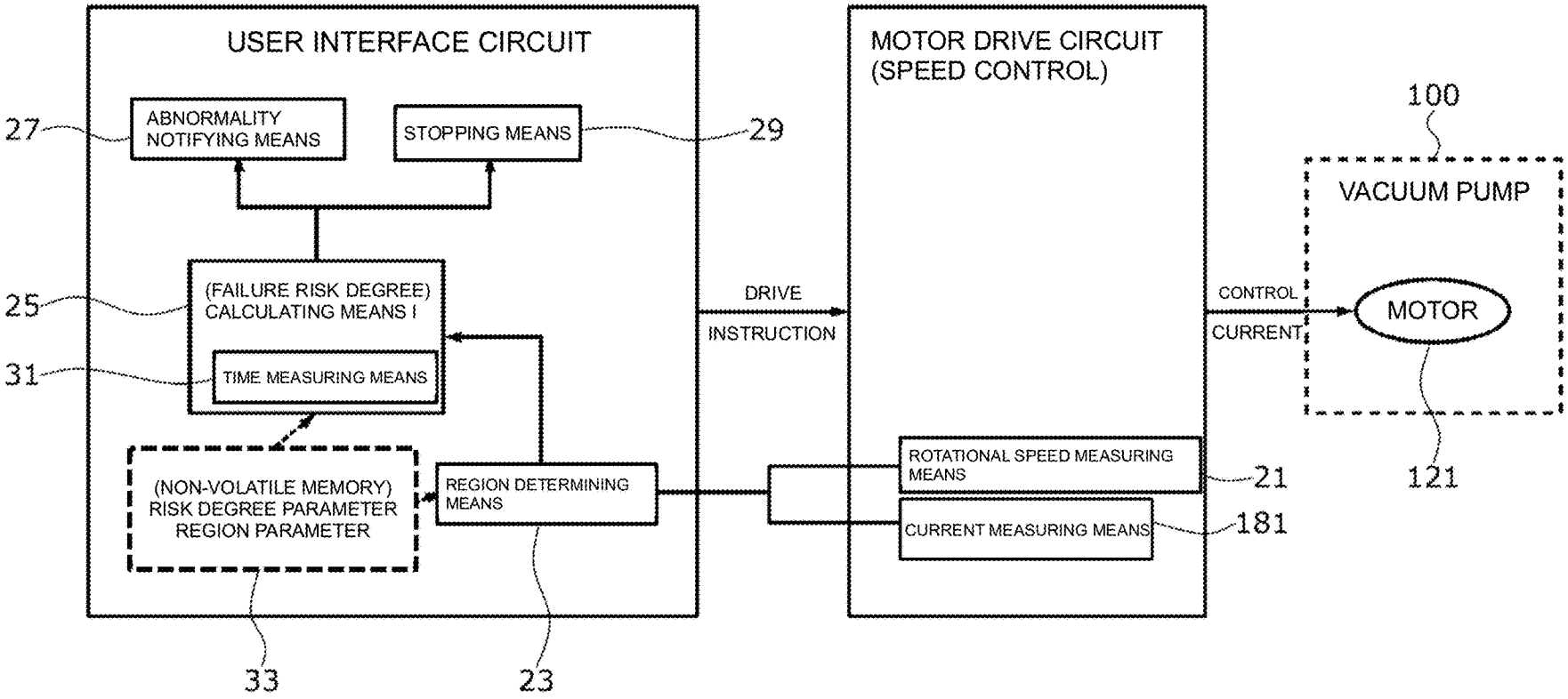
FIG. 5 is a block diagram of a protective function.

Hereinafter, the protective function that an abnormal state is efficiently notified and the pump is stopped on the basis of this notification before reaching the pump breakage in various cases including the aforementioned case will be described. A block diagram of this protective function is shown in FIG. 5.

If a temperature of the rotor blade 102 continuously rises due to a cause such as the friction heat with the process gas or the like, there is a risk that the cylinder portion 102*d* is expanded and is brought into contact with the threaded spacer 131. And in the worst case, it leads to destruction of the pump.

In order for the temperature of the rotor blade 102 to continuously rise, a state where the heat is stored for the rotor blade 102 continues. This heat storage state is considered to be caused when the current value of the motor 121 is high and the rotational speed of the rotor shaft 113 is high.

On the other hand, if a case where the rotational speed is low or the current value of the motor 121 is low continues, heat dissipation becomes more predominant than the heat storage, and the temperature of the rotor blade 102 gradually lowers. That is, this is a state where the heat stored once is dissipated with the process gas as a medium. Thus, in this protective function, first, the heat storage state is defined as follows.

Figure 6:
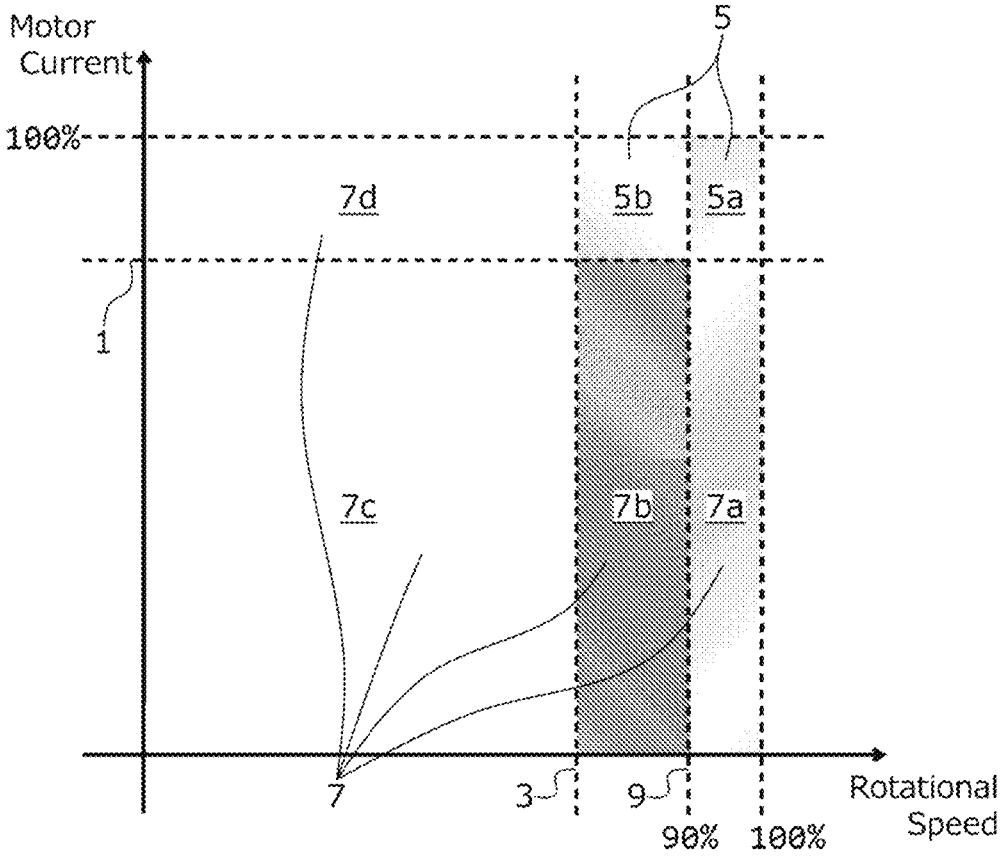
FIG. 6 is a rotational speed-motor current state monitoring diagram.

As shown in the rotational speed-motor current state monitoring figure in FIG. 6, a current specified value 1 is set to the current supplied to the motor 121, and a rotational speed specified value 3 is set to the rotational speed of the rotor shaft 113. And a region with a current measured value at the current specified value 1 or more and a rotational speed measured value at the rotational speed specified value 3 or more is defined as a heat storage region 5. In other words, heat storage region 5 is defined such that a current measured value is equal to or larger than current specific value 1, and a rotational speed measured value is equal to or larger than rotational speed specified value 3. This heat storage region 5 corresponds to the first region.

On the other hand, a region with the current measured value less than the current specified value 1 or the rotational speed measured value less than the rotational speed specified value 3 is defined as a heat dissipation region 7. This heat dissipation region 7 corresponds to the second region.

A set value of the current specified value 1 and a set value of the rotational speed specified value 3 are set as appropriate in accordance with a state of an actual operation of the pump, a type of the process gas and the like.

Then, from the rotational speed measured value and the current measured value 181, to which of the first region which is the heat storage region 5 and the second region which is the heat dissipation region 7 it belongs is determined by a region determining means 23 in a calculation program, which will be described later.

Subsequently, a first protective function to avoid the pump breakage will be described.

The first protective function is processed by installing the calculation program having this first protective function in the control device.

Figure 7:
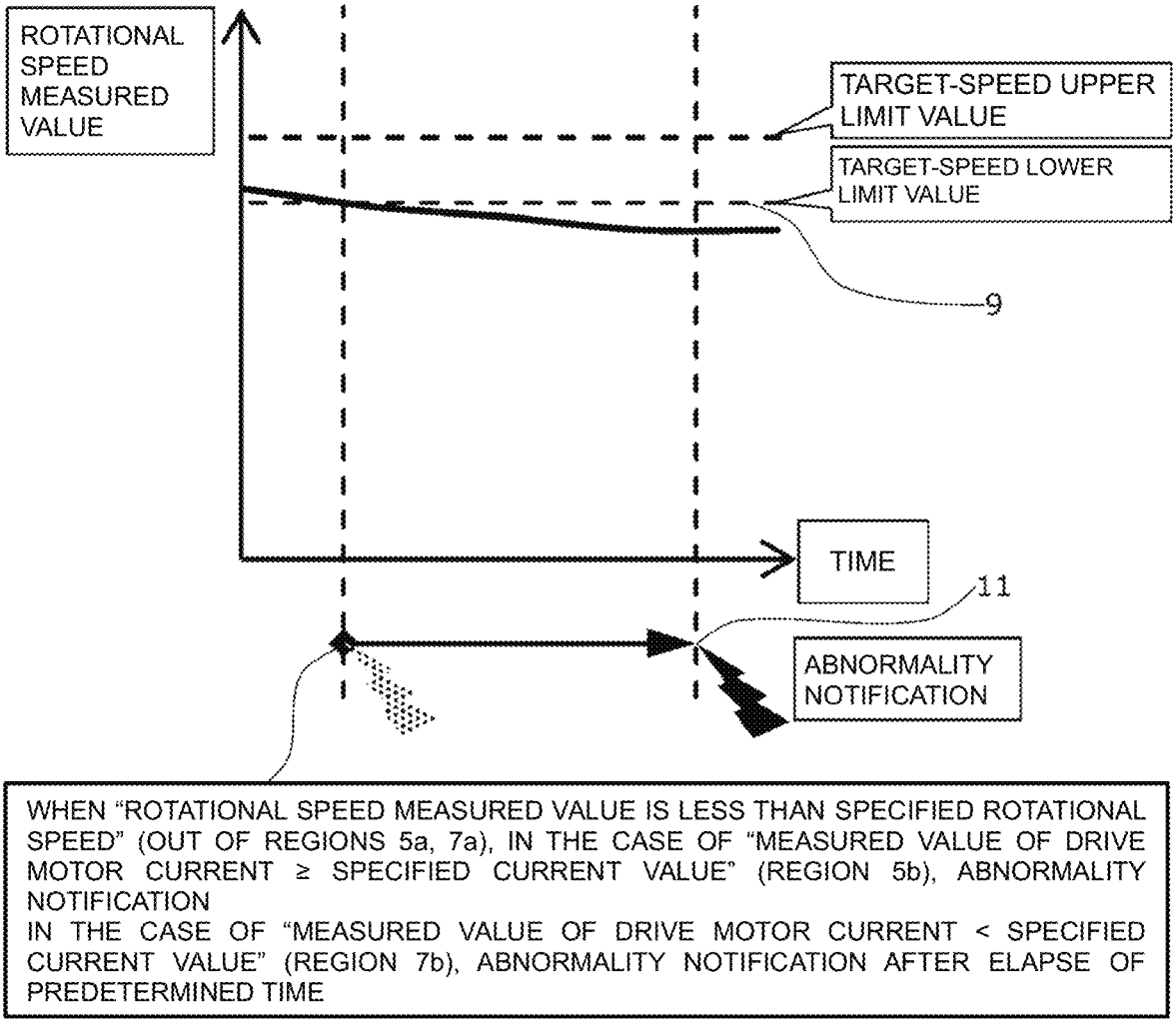
FIG. 7 is a diagram illustrating an abnormality state of rotational speed lowering during a pump operation.

In FIG. 6 and FIG. 7, a target rotational speed 9 is set to the rotational speed. This target rotational speed 9 is also set in accordance with the state of the actual operation of the pump, the type of the process gas and the like similarly to the rotational speed specified value 3. FIG. 6 illustrates an example in which the target rotational speed 9 passes through the heat storage region 5. Moreover, FIG. 7 illustrates a rotational-speed lowering abnormal state during the pump operation.

As shown in FIG. 6 and FIG. 7, when the operation state of the pump is in the heat storage region 5, if the rotational speed of the rotor shaft 113 lowers (region indicated by 5*b* in the figure) from a state exceeding the target rotational speed 9 (region indicated by 5*a* in the figure), it is determined to be abnormal by the calculating means 25, and abnormality notification is immediately made by the abnormality notifying means 27. And on the basis of this abnormality notification, the pump is stopped by the stopping means 29. If the rotational speed falls when the current value of the motor 121 is high and in an overload state, the friction heat with the process gas continues and thus, it is configured that the abnormality notification and the pump stop are performed immediately.

On the other hand, assuming that the target rotational speed 9 remains at the same set value as the above, when the operation state of the pump is in the heat dissipation region 7*b* less than the current specified value 1 and at the rotational speed specified value 3 or more, if the rotational speed of the rotor shaft 113 lowers (region indicated by 7*b* in the figure) from a state where the rotational speed of the rotor shaft 113 exceeds the target rotational speed 9 (region indicated by 7*a* in the figure), it is determined by the calculating means 25 to be abnormal after predetermined time has elapsed since the lowering of the rotational speed from the target rotational speed 9 as shown in FIG. 7, and abnormality notification 11 is made by the abnormality notifying means 27. The predetermined time is 30 minutes, for example. As a result, even in the heat dissipation state, the abnormality notification of the pump and stop of the pump on the basis of this abnormality notification can be performed safely by performing continuous monitoring.

Figure 8:
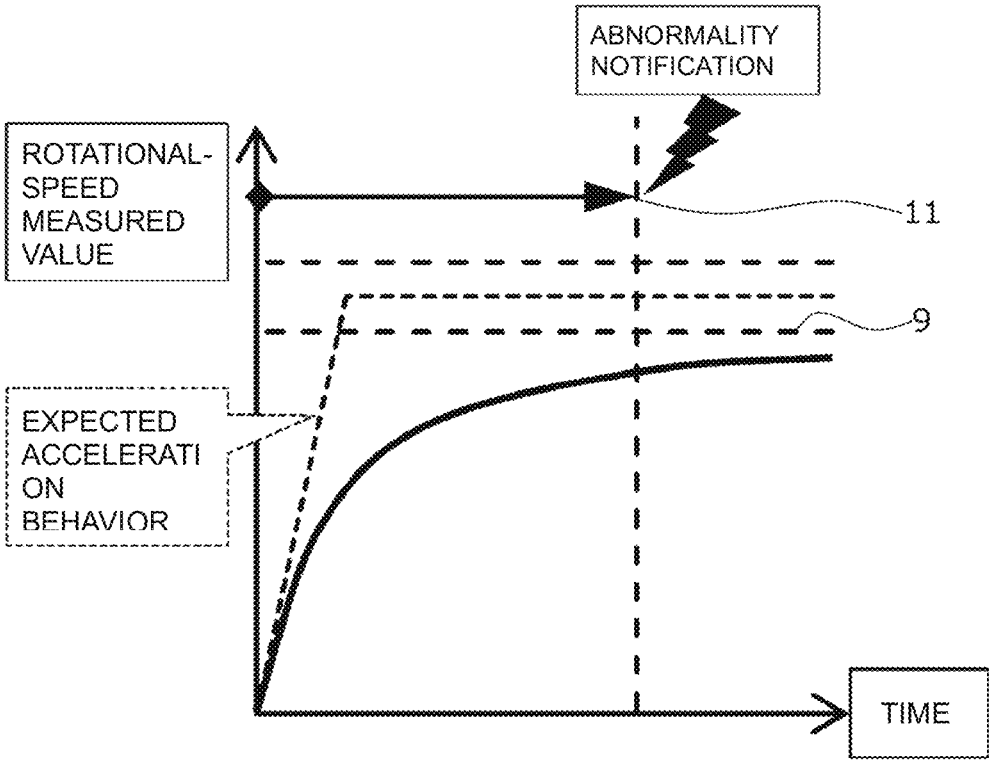
FIG. 8 is a diagram illustrating the abnormality state at start of the pump.

Moreover, this first protective function is an example in the figure illustrating the abnormality state at pump start in FIG. 8, and even in a case where the state not reaching an acceleration behavior expected at the pump start, the pump can be protected similarly.

And according to this first protective function, even if setting is made such that the target rotational speed 9 passes through the heat storage region 5 shown in FIG. 6, the pump can be protected, and even if the setting is such that the target rotational speed 9 does not pass through the heat storage region 5 as shown in FIG. 6, the pump can be protected.

For example, when the target rotational speed 9 is set to heat dissipation regions 7*c* and 7*d* less than the rotational speed specified value 3, if the rotational speed is continuously less than the target rotational speed 9 even after the predetermined time has elapsed since the pump start as shown in FIG. 8, it is determined by the calculating means 25 to be abnormal after elapse of this predetermined time, and the abnormality notification 11 is made by the abnormality notifying means 27. The target rotational speed 9 set to the heat dissipation region 7 less than the rotational speed specified value 3 corresponds to a second rotational speed. The predetermined time is similarly 30 minutes. As a result, even during the heat dissipation state, the abnormality notification of the pump and the pump stop can be performed safely by continuous monitoring.

Subsequently, a second protective function for avoiding the pump breakage will be described.

Figure 9:
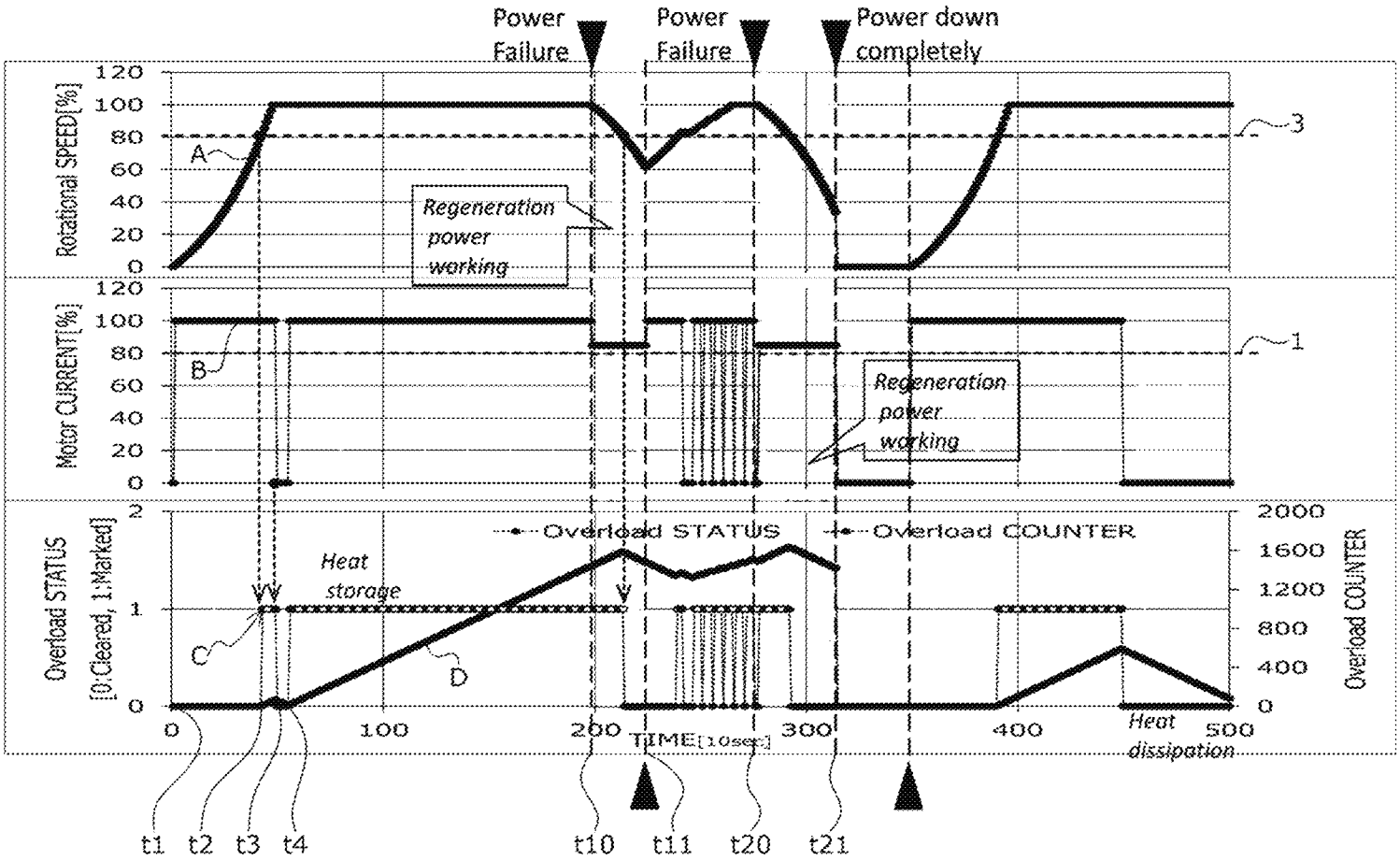
FIG. 9 is a simulation diagram performed for explaining a second protective function.

A processing method when the second protective function is used will be described on the basis of FIG. 9. FIG. 9 is a state of simulation performed for explaining the second protective function. In the second protective function, the region determining means 23 in the calculating program having the second protective function installed in the control device determines whether the pump load state is in the heat storage region 5 or in the heat dissipation region 7 on the basis of the current value of the motor 121 and the rotational speed value of the rotor shaft 113 which were measured at predetermined time periods. The predetermined time periods may be one second, for example.

FIG. 9 is a simplified simulation, and a timing chart of the rotational speed of the rotor shaft 113 is indicated by A in the figure, while a timing chart of the current of the motor 121 is indicated by B. The current of the motor 121 fluctuates more unstably during an actual operation. Thus, in order to efficiently detect a state of the fluctuation, determination is made every one second. Here, when it is determined that the load state of the pump is in the heat storage region 5, it is defined as "1", and when it is determined to be in the heat dissipation region 7, it is defined as "0". The timing chart of the pump load state organized as above is indicated by C in FIG. 9.

Subsequently, a determining method of a pump load state will be described specifically.

In FIG. 9, the current specified value 1 and the rotational speed specified value 3 are, as described in FIG. 6, set so as to partition the heat storage region 5 and the heat dissipation region 7 from each other. From time 0 to t1, the current value of the motor 121 is lower than the current specified value 1 and the rotational speed value of the rotor shaft 113 is lower than the rotational speed specified value 3 and thus, it is determined to be in the heat dissipation region 7, and "0" is set to the load state C. From time t1 to t2, the current value of the motor 121 is higher than the current specified value 1, and the rotational speed value of the rotor shaft 113 is lower than the rotational speed specified value 3 and thus, it is determined to be in the heat dissipation region 7, and "0" is set to the load state C. From time t2 to t3, the current value of the motor 121 is higher than the current specified value 1 and the rotational speed value of the rotor shaft 113 is higher than the rotational speed specified value 3 and thus, it is determined to be in the heat storage region 5, and "1" is set to the load state C. From time t3 to t4, the current value of the motor 121 is higher than the current specified value 1 and the rotational speed value of the rotor shaft 113 is lower than the rotational speed specified value 3 and thus, it is determined to be in the heat dissipation region 7, and "0" is set to the load state C. Hereinafter, the load state C is determined similarly also at this time and after.

And regarding the quantified load state C calculated as above, by providing a counter corresponding to time measuring means 31, it is configured such that this counter value indicates heat storage time. This counter value also indicates the risk degree of a failure of the pump. That is, if the pump operation state is in the heat storage region 5, this counter is added by the calculating means 25, while in the heat dissipation region 7, the counter is subtracted to zero. The counter performs counting every one second. A timing chart of this count value is indicated by D in FIG. 9. The count value D is counted up to 1800 at the maximum, for example, and when 1800 is reached, the abnormality notification is made. And on the basis of this abnormality notification, the pump can be stopped by the stopping means 29.

Note that, the counter value is set to 1800 at the maximum because one count per second exactly corresponds to heat storage for 1800 seconds (=30 minutes), and this continuation of heating for 1800 seconds is appropriate as determination standard for the abnormality notification.

In order to determine a failure of the pump, the maximum value of the counter, which is a reference value of the failure, is set, but if measuring time is every one second, it is sensorily easy for anyone to determine this failure reference value with the time until an actual failure is reached in a form in compliance with an actual state of the pump operation. Note that, however long the heat dissipation continues, the counter value does not become negative. An upper limit is the maximum count value at the maximum and thus, a capacity of a memory region occupied by the counter can be limited and small.

Moreover, in the case of abnormality of power failure at time t10, the motor 121 is continuously operated by inertia and then, it is brought into a regenerative braking state. And regenerated power is supplied to the control device. Thus, the aforementioned determination on the load state C and counting of the count value D are continuously performed. After that, assume that the power is recovered once at time t11, and abnormality of power failure occurs again at time t20. The operation is continued for some time in the regenerative braking state also at the time t20 and then, the power is completely shut down at time t21. The rotational speed also lowers by the time of complete shut-down of the power, and heat dissipation has progressed. Moreover, by touching down the touchdown bearings 141 and 143, the heat is directly conducted to the bearing. Therefore, when the operation of the pump is resumed again, the heat dissipation has been completely performed, and the determination of the load state C and the counting of the count value D can be performed again efficiently.

That is, the counting of the count value D is continued until the state supported by the magnetic bearing so as to avoid such a situation that the power is supplied, and the touchdown bearings 141 and 143 are touched down in the regenerative braking state, and at the touchdown on the touchdown bearings 141 and 143, the count of the count value D is reset to zero and thus, the load state C can be counted with accuracy. Therefore, the pump can be operated safely. Note that parameters for determination of the risk degree and regions are stored in a non-volatile memory 33.

As a result, there is no need to mount an expensive and non-contact temperature measuring function for the rotor blade 102 exclusively to avoid a failure, and the risk can be avoided inexpensively. That is, a pump breakage failure due to the abnormal overheat factor of the rotor blade 102 or the motor 121 can be avoided with an inexpensive method by the first protective function and the second protective function.

The first protective function and the second protective function can be installed as a calculation program also in an existing control device. Thus, it can be easily introduced even to a vacuum pump that has been delivered to a customer in the past, on which a rotor blade temperature sensor is not mounted, and the pump breakage failure can be avoided efficiently.

The present disclosure can be modified in various ways as long as the spirit of the present disclosure is not departed, and it is natural that the present disclosure also includes those modified. Moreover, each of the aforementioned examples may be combined in various ways.

The invention claimed is:

1. A vacuum pump comprising:

a rotor blade that sends a gas sucked through an inlet port to an outlet port;

a motor that rotates/drives the rotor blade;

a rotational speed measuring means that measures a rotational speed of the rotor blade; and a current measuring means that measures a current flowing through the motor, wherein;

a first region defined such that:

a current measured value measured by the current measuring means is equal to or larger than a current specified value, and a rotational speed measured value measured by the rotational speed measuring means is equal to or larger than a rotational speed specified value;

a second region defined such that:

the current measured value is less than the current specified value, or the rotational speed measured value is less than the rotational speed specified value;

a region determining means that determines to which region of the first region and the second region the rotational speed measured value and the current measured value belong; and a calculating means that calculates a risk degree of a failure of the vacuum pump based at least on one or more determinations by the region determining means.

2. The vacuum pump according to claim 1, further comprising:

a risk-degree threshold value set for the risk degree calculated by the calculating means;

an abnormality notifying means that notifies abnormality of the vacuum pump when the risk-degree threshold value is exceeded; and a stopping means that stops an operation of the vacuum pump when the abnormality of the vacuum pump is notified by the abnormality notifying means.

3. The vacuum pump according to claim 1- or 2, wherein:

when the current measured value measured by the current measuring means and the rotational speed measured value measured by the rotational speed measuring means are both in the first region, if the rotational speed measured value falls from a first rotation number set in advance to below the first rotation number, the calculating means determines that the risk degree is excessive.

4. The vacuum pump according to claim 1, wherein:

the calculating means includes a time measuring means that measures time during which rotation/drive is continued with the rotational speed measured value equal to or smaller than a second rotation number set in advance, when the current measured value measured by the current measuring means and the rotational speed measured value measured by the rotational speed measuring means are both in the second region; and when the time measured by the time measuring means becomes equal to or larger than first time set in advance, the risk degree is determined to be excessive.

5. The vacuum pump according to claim 1, wherein:

the calculating means includes a counter that numerically converts the risk degree, and executes processing for the counter of counting up when the rotational speed measured value and the current measured value belong to the first region, while executes processing of counting down when the rotational speed measured value and the current measured value belong to the second region according to a time period and based on the one or more determinations by the region determining means.

6. The vacuum pump according to claim 5, wherein:

when the count value of the counter exceeds a failure reference value determined in advance, the risk degree is determined to be excessive.

7. The vacuum pump according to claim 5, wherein:

the count value of the counter does not become less than zero.

8. The vacuum pump according to claim 5, wherein;

the time period is one second.

9. The vacuum pump according to claim 5, wherein:

when power source supplied to the motor is disconnected, regenerative braking is performed by rotation of the motor; and the count by the counter is continuously performed during the regenerative braking.

10. The vacuum pump according to claim 5, wherein:

when power source supplied to the motor is disconnected, and regenerative braking by rotation of the motor is finished, the count value of the counter is reset to zero.

11. A control device of a vacuum pump including:

a rotor blade that sends a gas sucked through an inlet port to an outlet port;

a motor that rotates/drives the rotor blade;

a rotational speed measuring means that measures a rotational speed of the rotor blade; and a current measuring means that measures a current flowing through the motor, the device comprising:

a first region defined such that a current measured value measured by the current measuring means is equal to or larger than a current specified value and a rotational speed measured value measured by the rotational speed measuring means is equal to or larger than a rotational speed specified value;

a second region defined such that the current measured value is less than the current specified value or the rotational speed measured value is less than the rotational speed specified value;

a region determining means that determines to which region of the first region and the second region the rotational speed measured value and the current measured value belong; and a calculating means that calculates a risk degree of a failure of the vacuum pump based at least on one or more determinations by the region determining means.

* * * * *